United States Patent [19]

Lenz et al.

[11] Patent Number: 4,678,026

[45] Date of Patent: Jul. 7, 1987

[54] COOLER FOR A WATER COOLED INTERNAL COMBUSTION ENGINE

[75] Inventors: Werner Lenz, Mühlacker; Manfred Möst, Tamm, both of Fed. Rep. of Germany

[73] Assignee: Suddeutsche Kuhlerfabrik Julius Fr Behr GmbH & Co., Fed. Rep. of Germany

[21] Appl. No.: 762,286

[22] Filed: Aug. 5, 1985

[30] Foreign Application Priority Data

Aug. 4, 1984 [DE] Fed. Rep. of Germany ..... 3428857

[51] Int. Cl.[4] ..... F28F 9/00; F28D 1/00

[52] U.S. Cl. ..... 165/67; 165/149

[58] Field of Search ..... 165/149, 67, 906; 180/68.4

[56] References Cited

U.S. PATENT DOCUMENTS

| | | | |
|---|---|---|---|
| 1,347,219 | 7/1920 | Gibson | 165/149 |
| 1,516,695 | 11/1924 | Atkinson | 165/149 |
| 2,056,318 | 10/1936 | Hammond | 165/149 |
| 2,205,984 | 6/1940 | Kromas | 165/149 X |
| 2,506,051 | 5/1950 | Young | 165/149 X |
| 4,328,859 | 5/1982 | Bouvot | 165/149 X |
| 4,382,464 | 5/1983 | Melnyk | 165/149 X |
| 4,540,044 | 9/1985 | Lenz | 165/149 |

FOREIGN PATENT DOCUMENTS

| | | | |
|---|---|---|---|
| 0102715 | 3/1984 | European Pat. Off. . | |
| 2435632 | 2/1975 | Fed. Rep. of Germany | 165/149 |
| 2259344 | 8/1975 | France | 165/149 |
| 8024894 | 11/1980 | France . | |
| 2522401 | 9/1983 | France | 165/149 |
| 269590 | 12/1933 | Italy | 165/149 |

*Primary Examiner*—Albert W. Davis, Jr.
*Assistant Examiner*—Randolph A. Smith
*Attorney, Agent, or Firm*—Barnes & Thornburg

[57] ABSTRACT

A water/air cooler is provided for water cooled internal combustion engines, especially for use in vehicles, which is constructed out of a cooler block held between water tanks and lateral parts. The lateral parts are connected with the water tanks by means of laterally overextending and gripping fastening brackets. These fastening brackets exhibit openings for engaging protruding connecting bolts on the water tanks. The brackets are affixed to the connecting bolts either through spring clamps or through corresponding protrusions having elastic clamping devices themselves. This water/air cooler is very easily assembled and is especially adapted for systems wherein the water tanks are manufactured out of plastic material.

15 Claims, 7 Drawing Figures

COOLER FOR A WATER COOLED INTERNAL COMBUSTION ENGINE

BACKGROUND AND SUMMARY OF THE INVENTION

The invention relates generally to an improved water/air cooler for a water cooled internal combustion engine. More particularly, the invention relates to coolers for commercial vehicles, within which the cooler block water tanks are fastened by means of lateral parts which are provided with fastening brackets which laterally extend over the water tanks at both ends. The lateral parts exhibit openings through which connecting pins, bolts or the like provided on the water tanks can be inserted, according to the U.S. Pat. No. 4,540,044.

An arrangement of the above type is disclosed in the U.S. Pat. No. 4,540,044 which is hereby incorporated by reference. In this patent, a water/air cooler is described wherein the lateral parts are attached to the water tanks without a soldering connection. Together with the water tanks the lateral parts form a stable frame construction for a cooler block formed from pipes and cooler lamella. With the arrangement according to this patent, it is provided that the water tanks are provided with holes which are aligned with bores formed in the fastening brackets so that fastening bolts or pins can be inserted through the fastening brackets and through the water tanks.

An object of the present invention is the provision of a water/air cooler construction of the above mentioned type (especially in the case of plastic manufactured water tanks) which exhibits a substantially simplified assembly.

These and other objects of the present invention are attained in the provision of a cooler construction wherein the connecting bolts and pins are fixedly arranged on the water tanks so that the process for the fitting of the bores in the fastening brackets and the water tanks and the subsequent insertion of the connecting bolts become unnecessary. The fastening brackets are formed out of two parallel spaced fastening or lashing parts, which grip over the associated water tank respectively on both sides. The fastening brackets exhibit a certain amount of elasticity in order to permit sufficient movement during the assembly process so that they can snap over the ends of the connecting pins. For this reason, the connecting pins are formed so that they do not extend any further out from the water tanks than necessary while still permitting the fastening parts to elastically slip thereover for convenient engagement.

An advantage exhibited by the new arrangement is that during the assembly, the lateral parts need only be shoved in a certain direction onto the ends of the water tanks until the connection pins of the tanks snap into the arranged openings in the lateral parts. With water/air coolers exhibiting fastening parts or lashings which are formed as a corner reinforcement and with respectively two openings for the connection pins which are at different distances from the outer side of the water tanks, it is especially advantageous and simple to provide the outer pin of the two connecting pins with a special surface. This outer pin has a surface which slants upwardly from the outer side of the cooler toward the center line of the cooler. This outer pin surface permits the lashing or connecting part to readily slide and snap over the connecting pins or elements.

The design of the present invention enables the connecting pins to be formed in a simple manner as a unitary part of the water tanks. When the water tanks are constructed of plastic, they can be first formed with the connecting pin parts which will be employed at a later time for connection with the lateral parts.

With this arrangement, the connecting pins formed as guide protrusions exhibit a cross section which is not circular. Alternatively, as in the above-incorporated patent, the fastening pins can be formed to be round and be provided with a security device in the form of a spring clamp for holding the connecting parts to the water tanks. With the improved arrangement of the present invention, the security device is advantageously formed as an elastically bendable protrusion device at a free end of the connecting pins. In a simplle manner, two oppositely disposed protrusion hooks are formed, which, in an especially advantageous design, form a part of the lateral walls of a connecting pin having a rectangular cross section. The central portion of this pin is formed in a double-T shape. Also, the second connecting bolt exhibits a non-circular cross section.

Such a form permits, in a simple manner, the connecting pins to be constructed out of plastic. Also the form of the connection is easily releasable. In order finally to assure exact positioning of the lateral parts of the water tank, it is advantageous to provide ribs in the region adjacent at least one of the connecting pins. The free facing side of the ribs serve as an abutment surface for the abutting portion of the lateral part.

Other objects, advantages and novel features of the present invention will become apparent from the following detailed description of the invention when considered in conjunction with the accompanying drawings.

DETAILED DESCRIPTION OF THE DRAWINGS

Figures 1, 2:
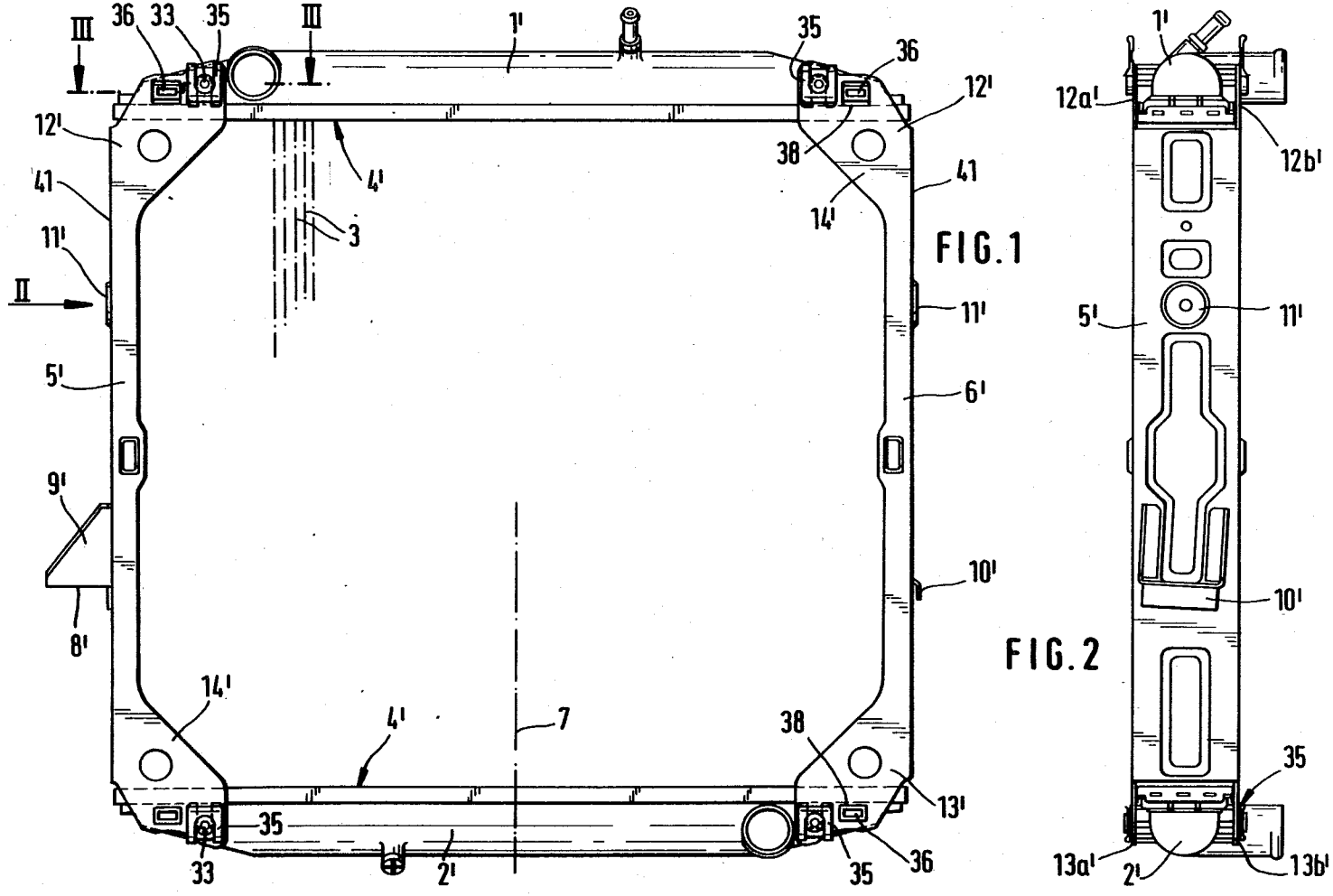
FIG. 1 is a schematic frontal view of a new water/air cooler according to a prepared embodiment of the present invention.
FIG. 2 is a side view of the cooler of FIG. 1, taken in the direction of the arrow II.

In FIGS. 1 and 2 there is shown (as also generally in the U.S. Pat. No. 4,540,044 a water/air cooler for a vehicle which comprises an upper water tank 1' constructed out of plastic and a lower water tank 2' also constructed out of plastic. Between tanks 1' and 2' there are arranged pipes or tubes for guidance of cooling water. The axes 3 of these pipes or tubes which extend perpendicularly to the fastening flange 4' of the water tanks 1' and 2' are schematically illustrated in FIG. 1. The tubes arranged in the direction of the axis 3 are provided with ribs in a known manner and form together with a pipe or tube base (not illustrated) a cooler block which is manufactured through a soldering connection. The tube header or tube plate is connected in a certain manner with the arranged flange 4' of the water tanks 1' and 2' (also in a known manner.)

For fastening the coolers in vehicles, the lateral parts 5' and 6' are provided. They are formed as profile parts out of metal, or are formed in the same manner that the water tanks are formed out of a plastic exhibiting sufficient stability. The lateral parts 5' and 6' are formed in an essentially symmetrical manner relative to the middle plane 7 of the cooler and exhibit different types of attachment devices for attaching the assembled cooler to the vehicle body. One lateral part 5' has a lateral downwardly slanting attachment flange 9' which is arranged over the lateral abutment surface 8'. This surface serves as an abutment surface for a part of the frame construction of the vehicle (not illustrated).

The other lateral part 6' is provided with an extended fastening hook 10'. Both lateral parts 5' and 6' also exhibit protrusions 11' which are provided with bores for the insertion of fastening screws. Each lateral part exhibits a very stable construction and each is provided at the upper end and at the lower end with fastening brackets or lashes 12' and 13' respectively, which laterally grip over the upper water tank 1' and the lower water tank 2'. The fastening brackets 12' and 13' comprise pairs of connecting parts **12*a'* and 12*b'* and 13*a'* and 13*b'* for gripping over the water tank 1' and 2' at the forward and reverse sides. They are formed as corner angles through the arrangement of diagonally extending connecting brackets 14'** which serve to increase the strength of the lateral parts in these regions.

Figure 3:
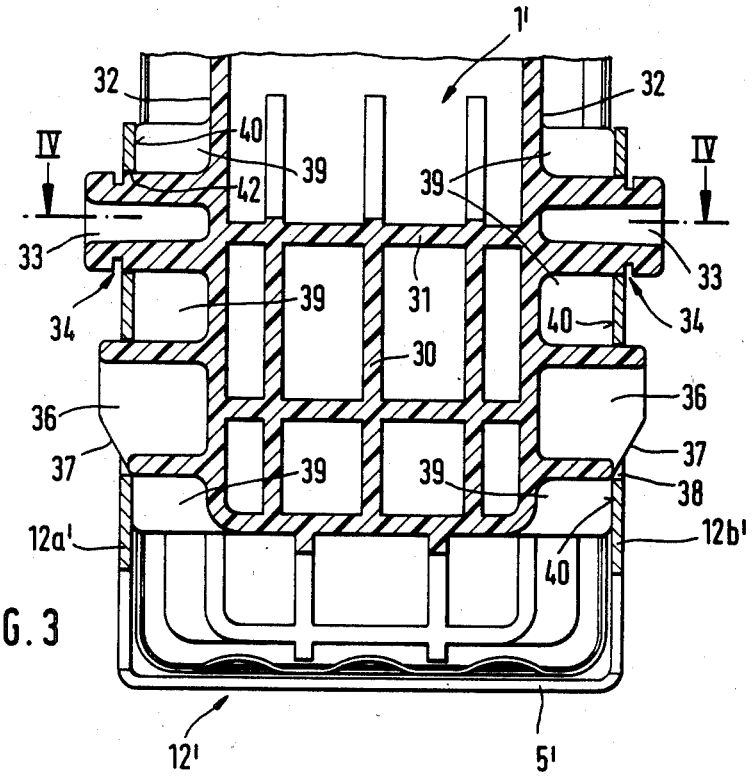
FIG. 3 is an enlarged sectional view along the line III—III of FIG. 1.
Figure 4:
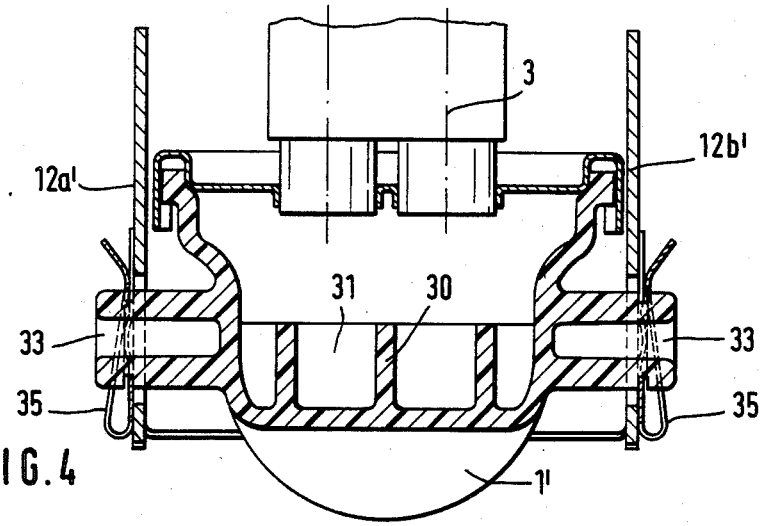
FIG. 4 is a sectional view along the line IV—IV of FIG. 3.

In FIGS. 3 and 4 it can be seen that the water tank 1' and, in an analogous manner (not shown), the water tank 2' are each provided with longitudinal and transverse ribs 30 and 31 which results in a very stable construction for the plastic parts which form both outer sides 32. Toward the outside are extending connecting pin sections or protrusions 33 in the form of hollow protrusions which are formed integrally with the material of the water tanks 1'. These parts are, for example, formed by casting or injection molding the plastic material. The connecting pins 33 furthermore exhibit circumferential grooves 34 in the region of their free ends. Spring clamps 35 illustrated schematically in FIG. 4, and of the type more fully disclosed in U.S. Pat. No. 4,540,044 are inserted in these grooves 34 and function as security holding devices for securing the lateral parts and water tank together.

Fixed to the water tank 1 and formed therewith is a further nonsymmetrical connecting element 36 which, as can be seen from FIG. 1, is disposed on the sides of the water tanks 1' and 2', respectively, a short distance from the lateral parts 5' and 6'. This connection element 36 exhibits a climbing abutment protrusion 37 which extends upwardly toward the longitudinal middle plane of the cooler. For manufacturing convenience, element 36 is formed as a short hollow protrusion. However, in contrast to the connection pin protrusion 33, element 36 is not round in cross section, but rather rectangular. This connection protrusion 36 also extends not as far outwardly from the side 32 as does the connection protrusion 33. It fits, however, in a corresponding complementary opening 38 in the connecting part **12*a'*, 12*b'* of the lateral parts 5'. The arrangement of the connecting parts 13*a'* and 13*b'* and at the other lateral part 6'** is analogous.

In the region of the two connecting protrusions 33 and 36, there are outwardly extending ribs 39 provided on the water tank 1' (analogously also on the water tank 2') which serve as abutment surfaces for the connecting parts **12*a'* and 12*b'* at the free facing sides 40. The lateral parts 5' and 6' can thereby laterally be shoved onto the water tanks as, for example, by moving the outer part 5' in the direction of arrow II in FIG. 1. The connecting parts 12*a'* and 12*b'* extend during this assembly process with their free ends on the abutment surface 37 of the outer connecting abutment 36 and are thrusted apart. This is possible because the fastening parts 12' and 13' exhibit corresponding elasticity. FIG. 1 shows that the fastening parts 12', 13' in the region of the fastening protrusion 33 and 36 are not connected through the outer facing wall 41, but rather extend parallel to one another freely. They can be spread apart with respect to one another thereby while being slid over the connection protrusions 36 until they snap with their openings 38 by further pushing over these protrusions 36. Simultaneously the round openings 42 snap over the connection protrusions 33 of the embodiment according to FIG. 1 through 4, thereby resulting in the arrangment illustrated in FIG. 3. It is sufficient then to insert spring clamps 35 so that the latter parts 5' and 6' are secured to the water tanks 1' and 2'**.

Similar to the arrangement of the aforementioned patent, in the region of the fastening parts 13', i.e. at the lower side of the lateral parts 5' and 6', there is provided a fastening arrangement corresponding to the upper arrangement 12'. The dimensions of the openings 38 and 42 in the fastening parts 12' and 13' correspond closely to the dimensional arrangement of the fastening protrusions 33 and 36 in the direction transverse to the longitudinal middle plane 7 (i.e. the lateral dimension). In the direction parallel to the longitudinal middle plane 7, a so-called loose bearing is formed (which was also the case with the arrangement of the U.S. Pat. No. 4,540,044) wherein the dimensions of the openings 38 and 42 is greater than the dimension of the protrusions 33 and 36 (i.e. the longitudinal dimension).

Figure 5:
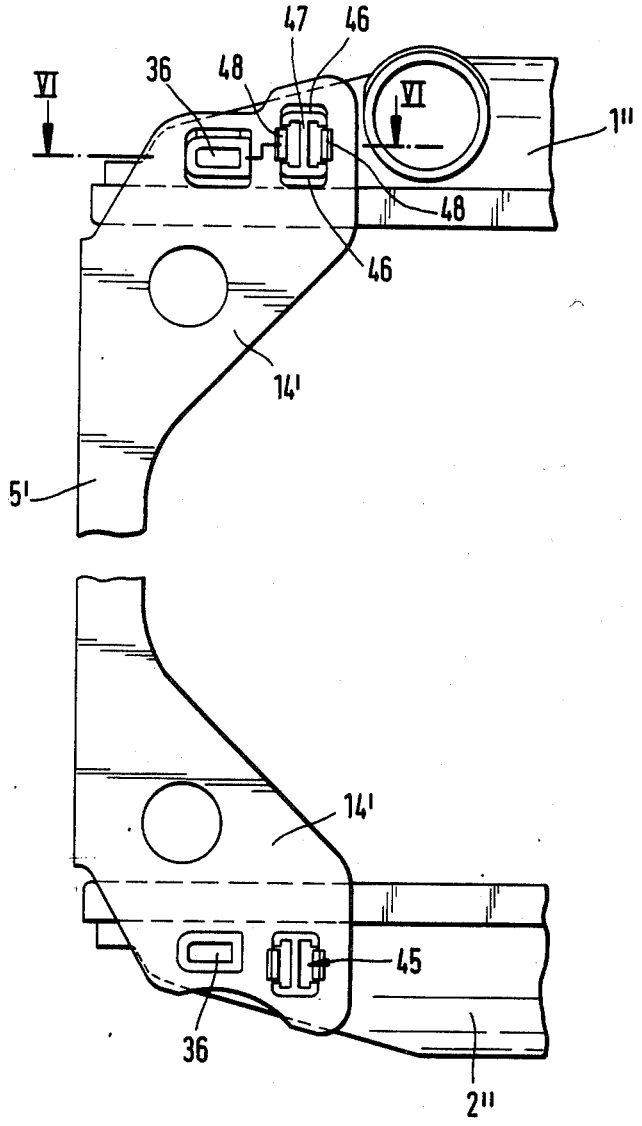
FIG. 5 is an enlarged partial view of the left region of the water/air cooler similar to FIG. 1, but having another type of fastening arrangement for the lateral parts of the water tanks according to another prepared embodiment of the invention.
Figure 6:
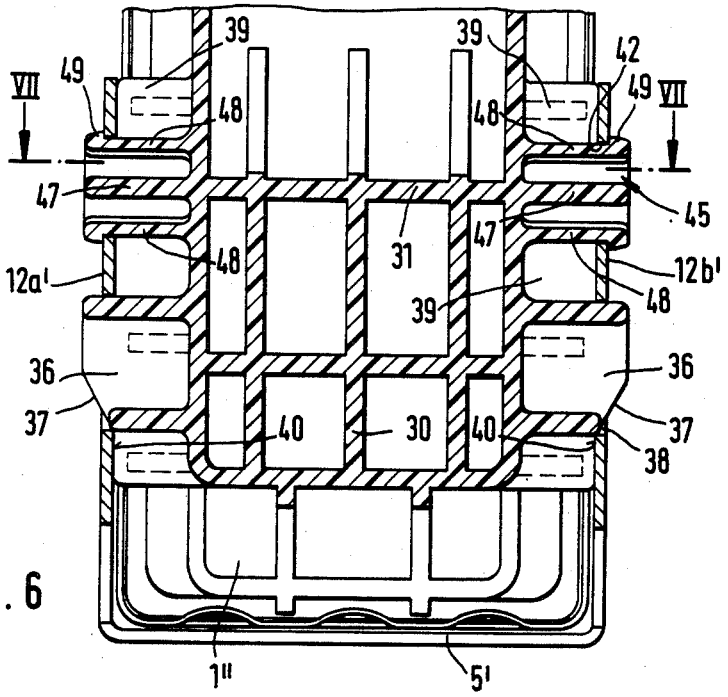
FIG. 6 is a sectional view along the lines VI—VI of FIG. 5.
Figure 7:
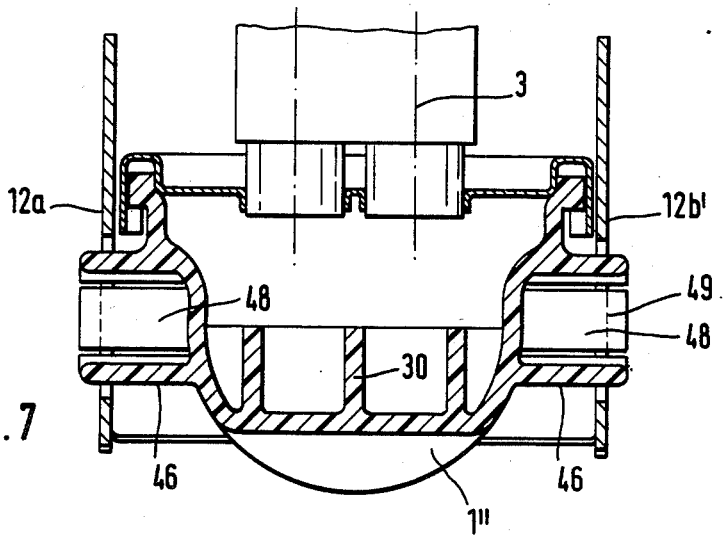
FIG. 7 is a sectional view along the line VII—VII of FIG. 6.

The development of FIGS. 5 to 7 corresponds respectively to the development of FIGS. 1–4. However, here the securing of the connecting parts **12*a'* and 12*b'* to the lateral part 5' and 6' is not effected through a spring clamp 35 security holding device. Rather, the securing is effected through an elastic protrusion device at the corresponding inner side of the connection protrusion 33. The remaining embodiment corresponds respectively to the embodiment of FIGS. 1–4. For the corresponding parts the corresponding reference numerals are indicated. The connection protrusion 45 disposed closer to the longitudinal middle plane 7 (as shown in the embodiment of FIGS. 5–7), possesses, in contrast to the connection protrusion 33, a somewhat rectangular outward cross-section which exhibits a double-T shape middle part 47 formed out of the two outer walls 46. The remaining two wall parts form a rectangular cross-section and comprise spring loaded protruding hooks 48. At their outer end, the spring hooks 48 are provided with hooks which grip through the openings 42 in lashing parts 12*a'* and 12*b'* and hold the lashing parts at the abutment surfaces 40 of the ribs 39 after the engagement. This embodiment allows assembly without an auxiliary manufacturing procedure. The lateral parts 5' and 6' can be pressed on the abutment surface of the connection protrusion 36 and then over the free ends of the water tanks 1' and 2'. Openings 38 and 42 snap over connecting protrusions 36 and 45. The two protrusions 48 are pressed inwardly toward one aanother until the protrusion hooks 49 grip over the outer surface of the lashing parts 12***a'* and 12*b'* and hold the fastening parts fixedly at the abutment surface 40 of the ribs 39.

Although the invention has been described and illustrated in detail, it is to be clearly understood that the above is to be taken by way of illustration and example only and not by way of limitation. The spirit and scope of the invention are to be limited only by the terms of the appended claims.

What is claimed is:

1. A radiator assemblly for a water cooled internal combustion engine having upper and lower water tanks, cooling block means for communicating fluid flow between said upper and lower water tanks and lateral part means for connecting said upper and lower water tanks, each said upper and lower tank having longitudinal sides, two end sides and a surface connecting said longitudinal sides and the two end sides, said lateral part means comprising a pair of parallel fastening bracket means for engagement with both said longitudinal sides of said water tanks, said fastening bracket means being elastically deformable in directions away from said longitudinal sides, said water tanks having connection pin means extending from said longitudinal sides, said pin means exhibiting a slanted surface for elastically deforming said fastening bracket means during slideable engagement of said fastening bracket means with said pin means, said fastening bracket means having openings for engagement of said connection pin means extending through said openings.

2. A radiator assembly according to claim 1, wherein said connecting pin means comprise inner and outer connecting pin protrusion means, and said fastening bracket means exhibit first and second openings for engagement with said connecting pin means.

3. A radiator assembly according to claim 2, wherein said outer connecting pin protrusion means includes said slanting surface, said slanting surface slanting upwardly in a direction toward a longitudinal center line of said radiator assembly.

4. A radiator assembly according to claim 3, wherein said outer connecting pin protrusion means has a non-circular cross section.

5. A radiator assembly according to claim 3, wherein said inner connecting pin means is provided with security holding means for holding said lateral part means to said water tank.

6. A radiator assembly according to claim 5, wherein said security holding means comprises an elastic flexible protrusion at a free end of said connecting pin means.

7. A radiator assembly according to claim 6, wherein said elastic flexible protrusion comprises a pair of oppositely disposed connecting hook means.

8. A radiator assembly according to claim 1, wherein said connecting pin means are unitary with said water tanks.

9. A radiator assembly according to claim 1, wherein said openings in said lateral part means have a lateral dimension corresponding to a lateral dimension of said connecting pin means.

10. A radiator assembly according to claim 9, wherein said openings in said lateral part means have a longitudinal dimension greater than a longitudinal dimension of said connecting pin means.

11. A radiator assembly according to claim 6, wherein said elastic flexible protrusion has a rectangular cross section and a double-T-shaped middle portion.

12. A radiator assembly according to claim 1, wherein said water tanks have rib means adjacent said connecting pin means, said rib means providing abutment surfaces for said lateral part means.

13. A radiator assembly according to claim 1, wherein said lateral part means have fastening bracket means for connecting said brackets to a vehicle body.

14. A radiator assembly according to claim 1, wherein said lateral part means are formed of plastic and said connection pin means are formed unitarily with said water tanks.

15. A radiator assembly according to claim 1, wherein said lateral part means are formed of metal and said connection pin means are formed unitarily with said water tanks.

* * * * *